United States Patent [19]

Torita

[11] Patent Number: 4,464,914

[45] Date of Patent: Aug. 14, 1984

[54] AUTOMATIC WASHER

[75] Inventor: Fumio Torita, Nagoya, Japan

[73] Assignee: Tokyo Shibaura Denki Kabushiki Kaisha, Kawasaki, Japan

[21] Appl. No.: 388,506

[22] Filed: Jun. 14, 1982

[30] Foreign Application Priority Data

Jun. 19, 1981 [JP] Japan ..... 95594
Jun. 22, 1981 [JP] Japan ..... 96849

[51] Int. Cl.[3] ..... D06F 23/04

[52] U.S. Cl. ..... 68/23.5; 68/148; 68/207

[58] Field of Search ..... 68/23.5, 148, 205 R, 68/207, 18 F, 18 FA

[56] References Cited

U.S. PATENT DOCUMENTS

| | | | |
|---|---|---|---|
| 2,971,362 | 2/1961 | Olding | 68/18 F |
| 3,335,584 | 8/1967 | Urban | 68/23.5 X |
| 3,557,579 | 1/1971 | Marshall | 68/23.5 |
| 3,952,556 | 4/1976 | Gakhar et al. | 68/207 X |

FOREIGN PATENT DOCUMENTS

| | | | |
|---|---|---|---|
| 3063667 | 6/1970 | Australia . | |
| 5959469 | 2/1971 | Australia . | |
| 26069 | 2/1979 | Japan | 68/23.5 |
| 1326737 | 8/1973 | United Kingdom | 68/23.5 |

*Primary Examiner*—Philip R. Coe
*Attorney, Agent, or Firm*—Cushman, Darby & Cushman

[57] ABSTRACT

An automatic washer of the present invention for automatically carrying out a series of steps of the washing operation comprises a rotary basket provided with a number of holes which permit liquid supplied to the basket to flow therethrough and holding the material to be washed throughout the washing operation, a tub fixed in a manner to surround the basket, and a spraying device mounted to a tub cover and positioned above the upper opening of the basket. During the dehydration-rinsing or centrifugal rinsing step, fresh water is sprayed from the spraying device into the region along the side wall of the rotary basket.

23 Claims, 17 Drawing Figures

AUTOMATIC WASHER

BACKGROUND OF THE INVENTION

This invention relates to an automatic washer, particularly, to an automatic washer in which fresh water is sprayed onto the washed material in the dehydration step to rinse the washed material.

It is known to the art that the rinsing effect can be further improved if fresh water is sprayed onto the washed material in the dehydration step because the detergent attached to the washed material is effectively replaced by the water. Japanese Patent Disclosure (Kokai) No. 50-90151 teaches an automatic washer of this type. Specifically, the washer disclosed in the prior art mentioned comprises a spraying device provided with a number of holes and serving to spray fresh water from above a rotary basket onto the washed material housed in the basket. However, the water is sprayed in a substantially rectangular region within the basket, failing to spray the water onto the entire region of the washed material. As a result, sufficient rinsing can not be realized in the dehydration step, rendering it necessary to employ an independent rinsing step. It follows that it is impossible for the prior art washer to shorten markedly the time required for the entire washing operation.

SUMMARY OF THE INVENTION

An object of this invention is to provide an automatic washer in which fresh water is effectively sprayed onto the washed material housed in a rotary basket in the dehydration-rinsing step, to eliminate the independent rinsing step and, thus, to save the amount of time and water required for the washing operation.

The automatic washer of the present invention comprises a rotary basket in which the washing materials (washings) are contained while a plurality of steps of the washing operation are automatically carried out in succession. The basket is provided with a plurality of holes through which a liquid such as water supplied to the basket may flow. The washer also comprises a tub housing the basket and storing the liquid flowing out of the basket through the holes. The liquid stored in the tub is discharged when required. The upper opening of the basket is kept at a substantially constant position even during rotation of the basket, and a spraying device is positioned above the upper opening of the basket. The spraying device temporarily stores the water supplied from a water supply section and the stored water is sprayed, while fresh water is being supplied to the spraying device, onto the inner space near the side wall of the basket. As a result, the washed material within the basket is effectively rinsed.

DETAILED DESCRIPTION OF THE PREFERRED EMBODIMENTS

Figure 1:
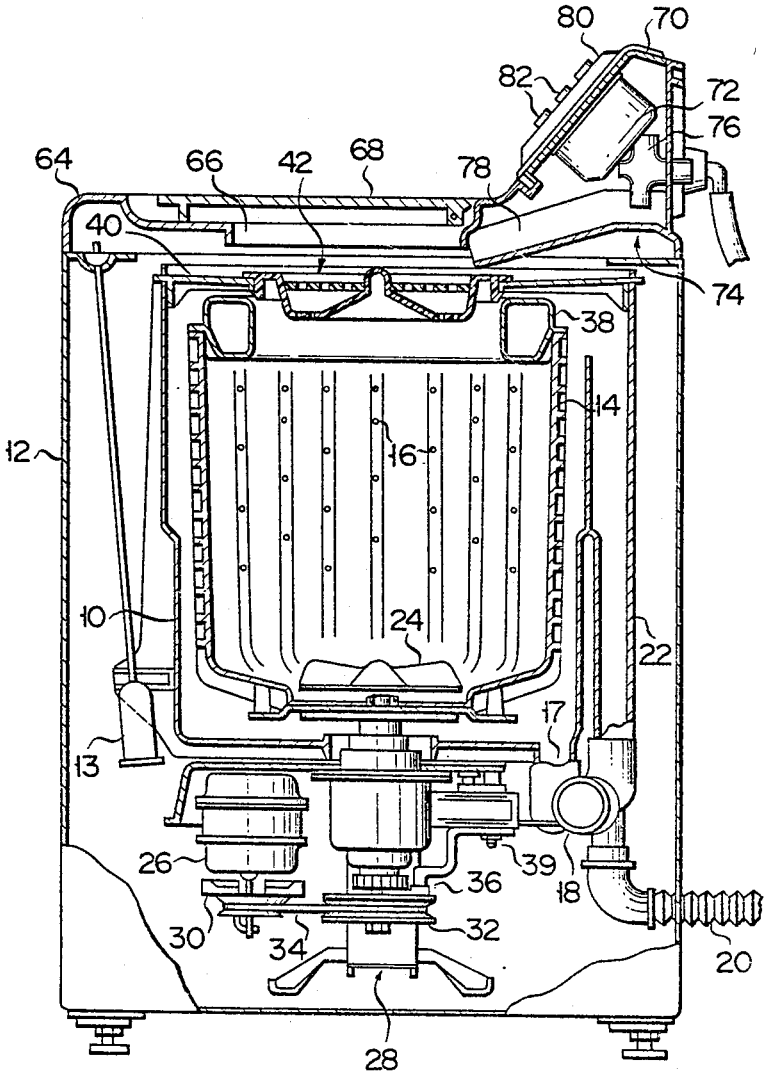
FIG. 1 is a cross sectional view showing an automatic washer which includes a spraying device according to one embodiment of the present invention.

Referring to FIG. 1, a tub 10 is vertically and immovably built in an outer case 12 by means of elastic support 13. A basket 14, which is rotatably mounted within the tub 10, is substantially coaxial with the tub 10. The side wall or peripheral wall of the basket 14 is provided with a number of holes 16 and the washing is kept housed in the basket 14 throughout the entire washing operation. Provided in the corner of the bottom of the tub 10 are a discharge port 17 and a drain valve 18 coupled to a drain passage, e.g., drain hose 20. Further, an overflow passage 22 is coupled to the drain hose 20. A pulsator or stirring blade 24 coupled to a motor 26 through a drive transmission 28 is rotatably provided in the center of the bottom of the basket 14. The drive mechanism 28 includes pulleys 30, 32, a belt 34 and a clutch mechanism 36, thereby to selectively transfer a motor torque either to the stirring blade 24 or to the basket 14. A balance ring 38 is mounted to the periphery of the upper open end of the basket 14. A reference numeral 39 denotes a brake mechanism.

A tub cover 40 provided with a central opening is attached to the circular upper end of the tub 10. In this embodiment, the opening of the tub cover 40 is substantially equal in size to the upper opening of the basket 14, and a spraying device 42 is detachably mounted to the opening of the tub cover 40. Thus, the spraying device 42 once mounted is always positioned above the opening of the basket 14 whether the basket 14 is rotated or stopped. As shown in a magnified fashion in FIGS. 2 and 3, the spraying device 42 includes a vessel 44 and a lid 46. FIG. 3 shows that the vessel 44 comprises a recess 48 and a flange 50 radially extending outward from the circular upper end of the wall defining the recess 48. Also, the bottom of the recess 48 is provided with a number of small water-passing holes 52. A plurality of hooks 54 are mounted to the lower surface of the flange 50 so as to enable the spraying device 42 to be elastically engaged with the inner periphery of the tub cover 40. On the other hand, the lid 46, which is substantially of disk-shape, is fixed to the inner surface of the wall defining the recess 48 of the vessel 44. The lid 46 is disposed a prescribed distance apart from the bottom of the recess 48 by a projection 58 projecting upward from the bottom of the recess 48. As seen from FIG. 2, the lid 46 is also provided with a number of water-passing holes 60.

Figure 4:
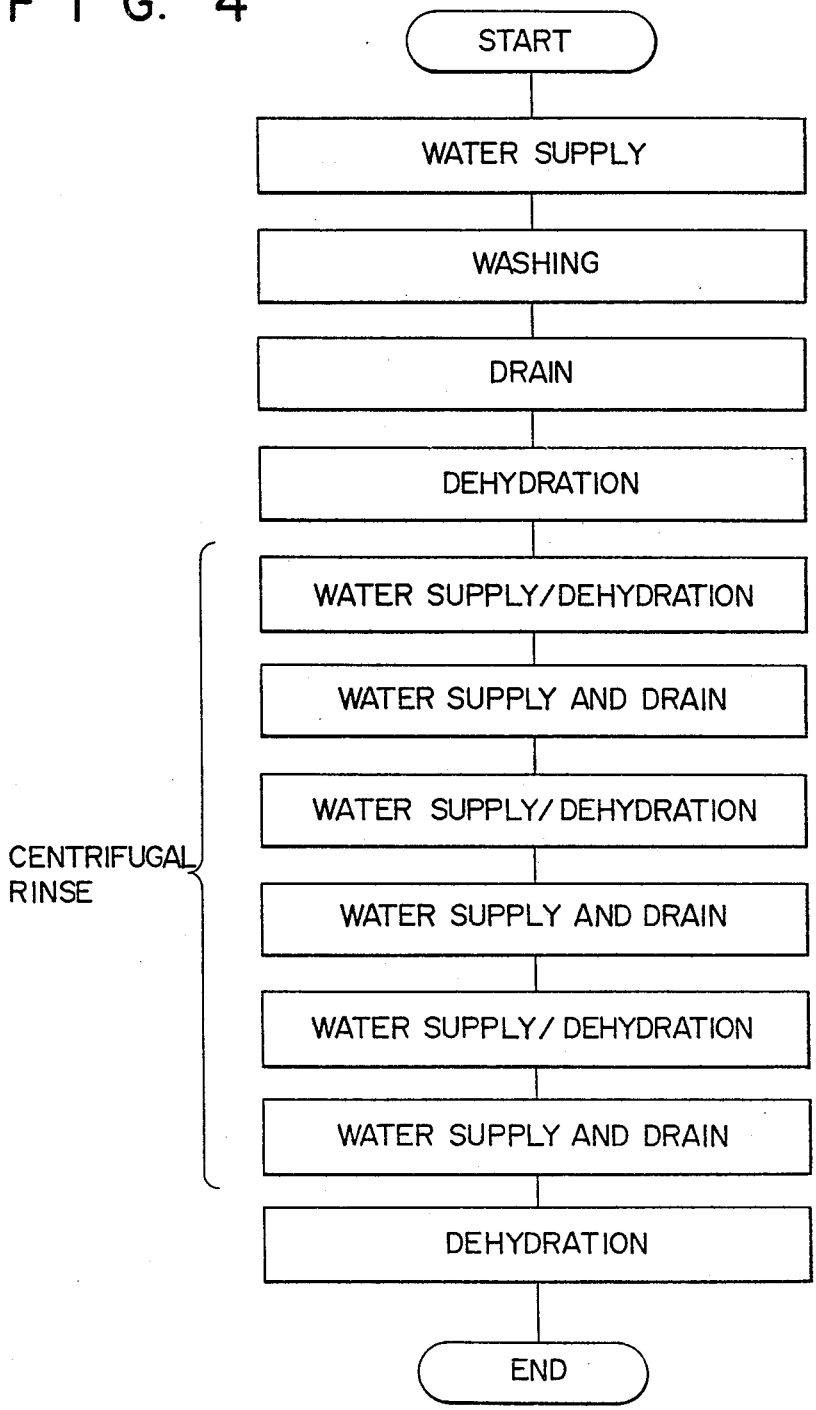
FIG. 4 is a flow chart showing the standard washing processes of the washer shown in FIG. 1.

Returning to FIG. 1, a reference numeral 64 denotes an upper case fixed to the outer case 12. The upper case 64 is provided with an opening 66 through which the washing may be loaded into and unloaded from the basket 14, and also includes a lid 68. A reference numeral 70 denotes an operation box. Included in the operation box 70 are an operation control device 72 and a water supply device 74 which is comprised of a water valve 76 and a conduit 78. The water supplied to the valve 76 flows through the conduit 78 so as to be introduced into the spraying device 42 attached to the tub cover 40. In addition, provided outside the operation box 70 is a control panel 80 including switch knobs 82 which are operated by an operator for designating a desired washing program. The washing programs are stored in a memory (not shown) included in the operation control device 72. In the automatic washer described above, the entire washing operation is carried out as a standard mode in accordance with the flow chart shown in FIG. 4.

In operating the automatic washer shown in FIG. 1, the lid 68 is opened first and the spraying device 42 is taken outside, followed by loading the washing (not shown in FIG. 1) into the rotary basket 14. Then, the switch knob 82 mounted to the control panel 80 is operated for starting the washing operation. If the program of standard course shown in FIG. 4 has been selected, the washer valve 76 is opened first so as to allow fresh water to flow through the conduit 78 and the spraying device 42 into the basket 14. When the optimum amount of water has been supplied to the basket 14 with respect to the amount of the washings put in the basket 14, the water valve 76 is closed so as to enable the washer to perform automatically the washing, draining and dehydrating steps in succession in accordance with the flow chart of FIG. 4. Incidentally, U.S. patent application Ser. No. 210,532 filed by the present inventor on November 25, 1980 discloses how to detect the optimum amount of water supply mentioned above.

After the dehydration step, the automatic washer performs a dehydration-rinsing function or the function commonly referred to in this field as a "centrifugal rinse". The principle of dehydration-rinsing function or centrifugal rinse is known to the art as seen from, for example, Japanese Patent Disclosure No. 50-90151 (Tobita et al) laid open for public inspection on July 19, 1975. In this step, the water valve 76 is kept open so as to supply water continuously into the basket 14 and the basket 14 is intermittently rotated at a high speed at prescribed time intervals for the dehydration purpose.

Figure 5:
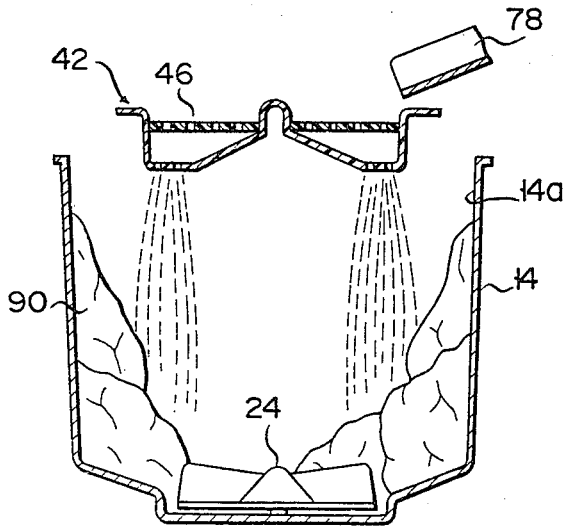
FIG. 5 shows how the water is sprayed into the basket from the spraying device shown in FIGS. 1 to 3.

FIG. 5 shows how the water is supplied to the basket 14. It should be noted that the centrifugal force accompanying the rotation of the basket 14 permits the washings 90 to be distributed along the inner peripheral surface 14*a* of the basket 14. On the other hand, the fresh water supplied to the spraying device 42 is sprayed through the small holes 52 made in the recess 48 of the vessel 44 onto the inner space along the side wall of the rotary basket 14. In other words, the fresh water is sprayed directly onto the washings 90 distributed along the side wall of the basket 14 and, thus, is effectively utilized in the centrifugal rinsing step.

As mentioned previously, the basket 14 is intermittently rotated while the fresh water is being sprayed onto the washings 90, with the result that the washings 90 is dehydrated. Then, power to the motor 26 is stopped so as to allow the basket 14 to make an inertial rotation. Naturally, the centrifugal force exerted on the washings 90 is lowered, with the result that the fresh water sprayed onto the washings 90 uniformly permeates into the washings 90. It follows that the detergent remaining within the washings 90 is released into the excess water contained in the washings 90. When the basket 14 has been rotated again at a high speed, the water containing the detergent is centrifugally released from the washings 90 into the tub 10 through the holes 16 made in the basket 14. As seen from FIG. 4, the centrifugal rinsing operation described above is repeated, for example, three times so as to effectively remove the detergent attached to the washings 90. It is important to note that, in the present invention, the fresh water is effectively and uniformly sprayed from the spraying device 42 onto the washings 90, rendering it possible to remove the remaining detergent substantially completely. As a result, it suffices to perform a dehydrating operation after completion of the centrifugal rinsing step for bringing the entire washing operation to the end. In other words, it is unnecessary to provide an independent rinsing step, for example, a so-called "overflow-rinsing", after the centrifugal rinsing step, thus leading to saving of water and time required for the washing operation. To be brief, the automatic washer of the present invention permits enhancing the rinsing effect, shortening the washing operation time and saving the water consumption.

As seen from FIG. 1, the spraying device 42 is disposed in a manner to close the upper opening of the rotary basket 14. Thus, even if the lid 68 has been opened by the operator in the dehydration step or centrifugal rinsing step, it is impossible for the operator's hand to directly touch the basket 14 while it is making an inertial rotation. In other words, the spraying device 42 serves to protect the operator from the danger of touching the rotating basket 14.

Figure 2:
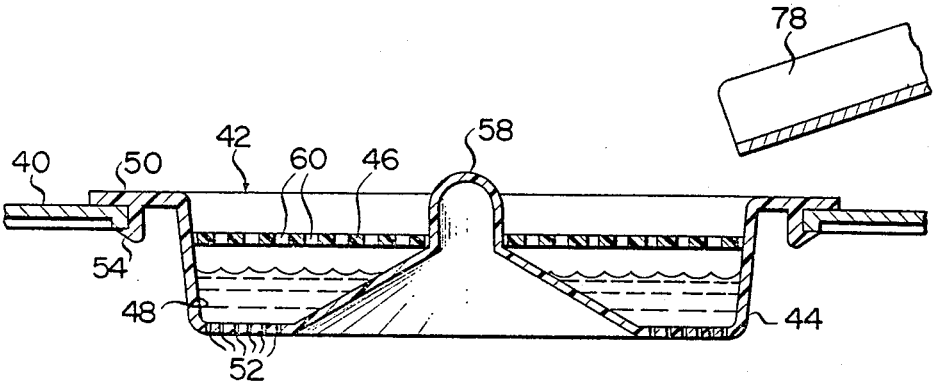
FIG. 2 is a cross sectional view showing in a magnified fashion the spraying device included in the washer shown in FIG. 1.
Figure 3:
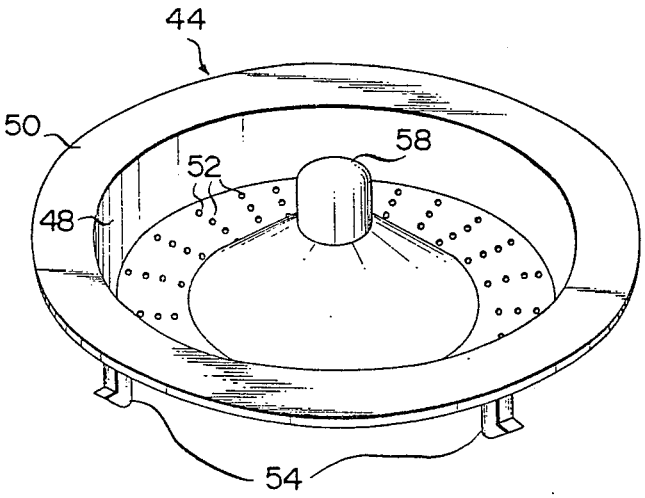
FIG. 3 is an oblique view of the spraying device shown in FIG. 2.

It should also be noted that the fresh water stored in the spraying device 42 is waved as shown in FIG. 2 because the vibration of the basket 14 is transmitted to the spraying device 42. The vibration is serious particularly when the washings 90 are nonuniformly distributed within the basket 14. If the waving in question is excessive, the water is undesirably splashed outside the spraying device 42. In the present invention, however, the lid 46 provided with a number of holes 60 is mounted to the spraying device 42, as shown in FIGS. 1 and 2, to suppress the waving problem mentioned above.

Figure 6:
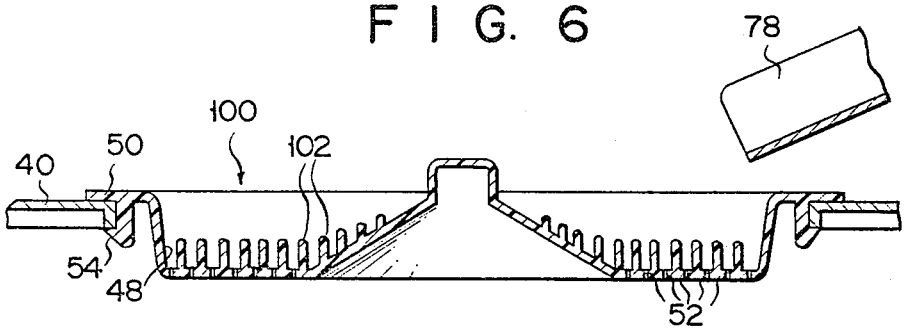
FIGS. 6 to 8 are cross sectional views each showing a modification of the spraying device shown in FIG. 1.
Figure 7:
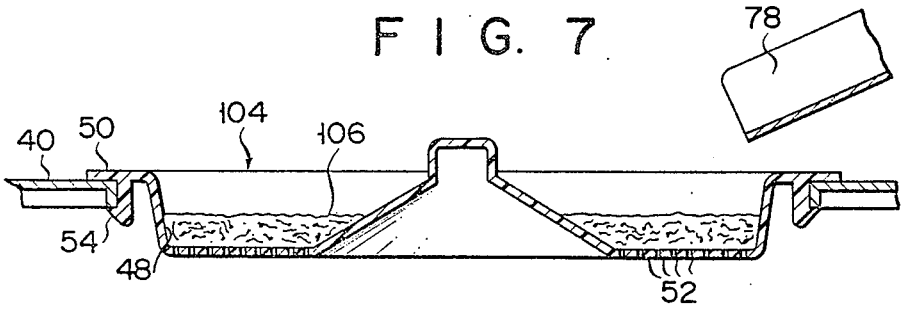
Figure 8:
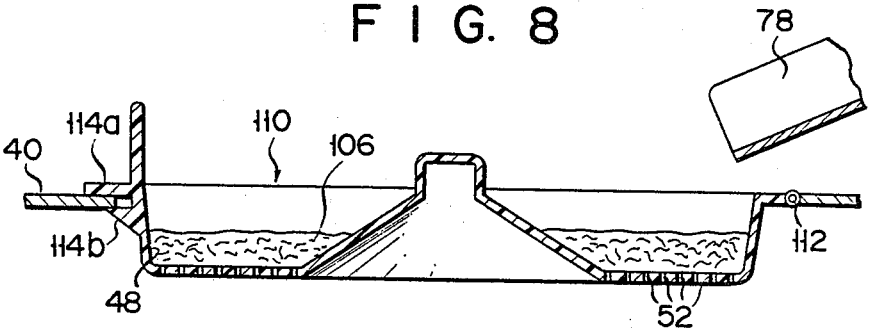

FIGS. 6 to 8 show modifications of the spraying device 42. In the modification of FIG. 6, a plurality of annular projections 102 are mounted to the bottom of the recess 48 of a spraying device 100. The projections 102 extend vertically upward and are concentric with each other. In this modification, the small holes 52 are provided between adjacent annular projections 102. The height of the annular projection 102 is set at, for example, about half the depth of the recess 48. It should be noted that the annular projections 102 serve to suppress the waving of the fresh water stored in the spraying device 100 because the water is prevented from moving freely within the spraying device 100.

In the modification of FIG. 7, the lower portion of the recess 48 of a spraying device 104 is loaded with a porous fibrous material 106. Naturally, the fibrous material 106 serves to prevent the fresh water from moving freely within the recess 48 and, thus, to suppress the waving of the water. In addition, the vigorous flow of the water supplied through the conduit 78 is moderated by the fibrous material 106, rendering it possible to prevent the water splashing within the spraying device.

In the modification of FIG. 8, the flange of a spraying device 110 is coupled at one end with the tub cover 40 by a hinge 112, with the other end of the flange provided with a pair of hooks 114*a* and 114*b* serving to hold the tub cover 40. Thus, the spraying device 110 is vertically swingable, with the result that the washings 90 can be easily loaded into and unloaded from the basket 14.

Figure 9:
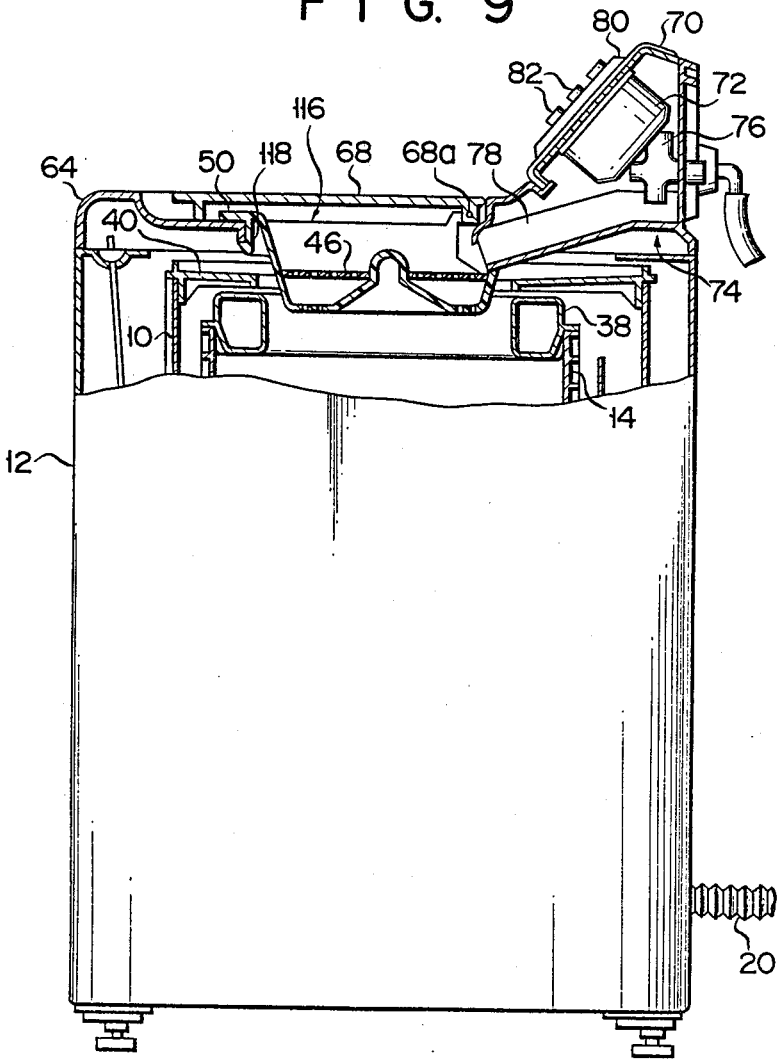
FIG. 9 is a cross sectional view showing an automatic washer according to another embodiment of the present invention.

FIG. 9 shows an automatic washer according to another embodiment of the present invention. The reference numerals common with FIGS. 1 and 9 denote the same members and, thus, the descriptions thereof are omitted. In the embodiment of FIG. 9, a spraying device 116 is swingably pivoted by a pivoting shaft 68*a* of the lid 68. In other words, the spraying device 116 is vertically swingable about the shaft 68*a*. When the washing is loaded into or unloaded from the basket, the lid 68 is opened first, followed by swinging up the spraying device 116. The spraying device 116 thus swung up can be rested stationary against the opened lid 68. When the washings have been put into the basket 14, the spraying device 116 is fixed to the upper case 64 by a hook 118.

Figure 10:
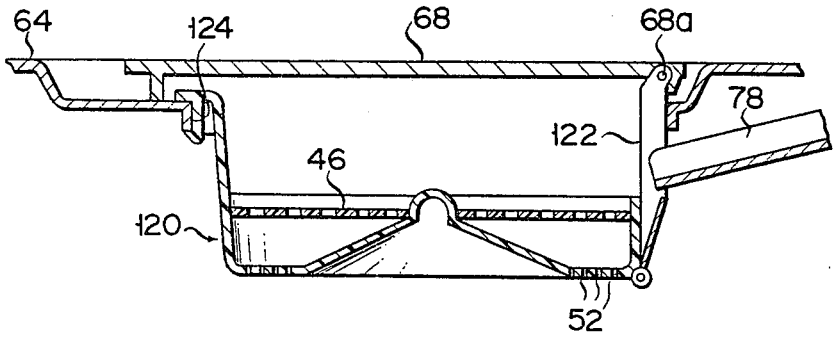
FIG. 10 is a cross sectional view showing a modification of the spraying device included in the washer shown in FIG. 9.
Figure 11:
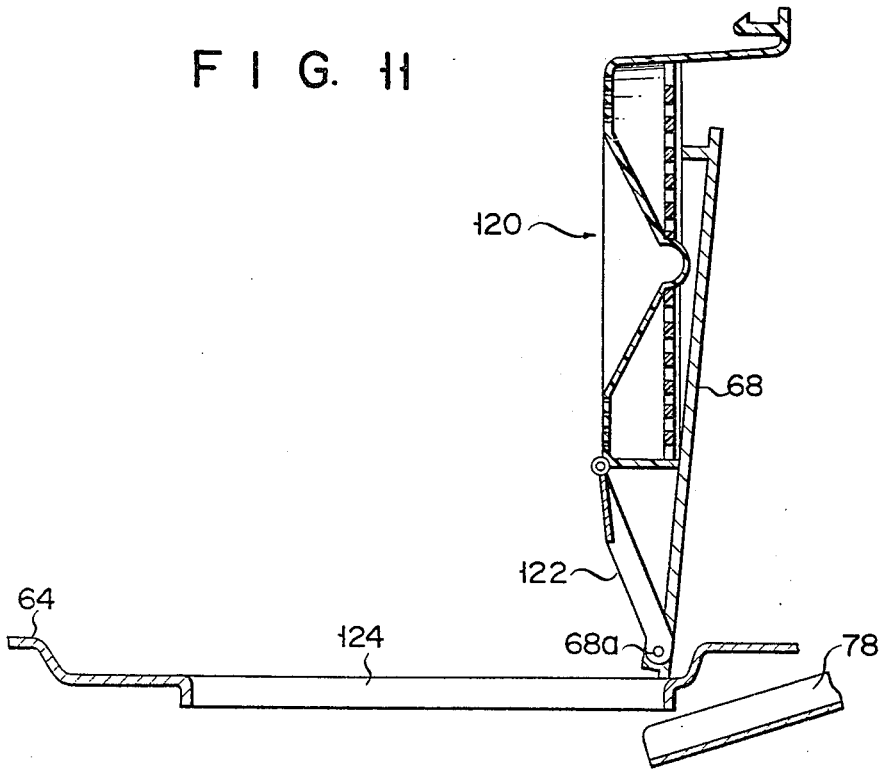
FIG. 11 is a cross sectional view showing the condition of the spraying device shown in FIG. 10 when it is swung up.

FIG. 10 shows a spraying device 120, i.e., modification of the spraying device 116. As apparent from the drawing, the spraying device 120 is provided with a link rod 122 whose free end is pivoted by the pivoting shaft 68*a*. The use of the link rod 122 permits the spraying device 120 to be rested stably against the back of the lid 68 as shown in FIG. 11. Incidentally, a reference numeral 124 shown in FIG. 11 denotes the opening of the upper case 64.

Figure 12:
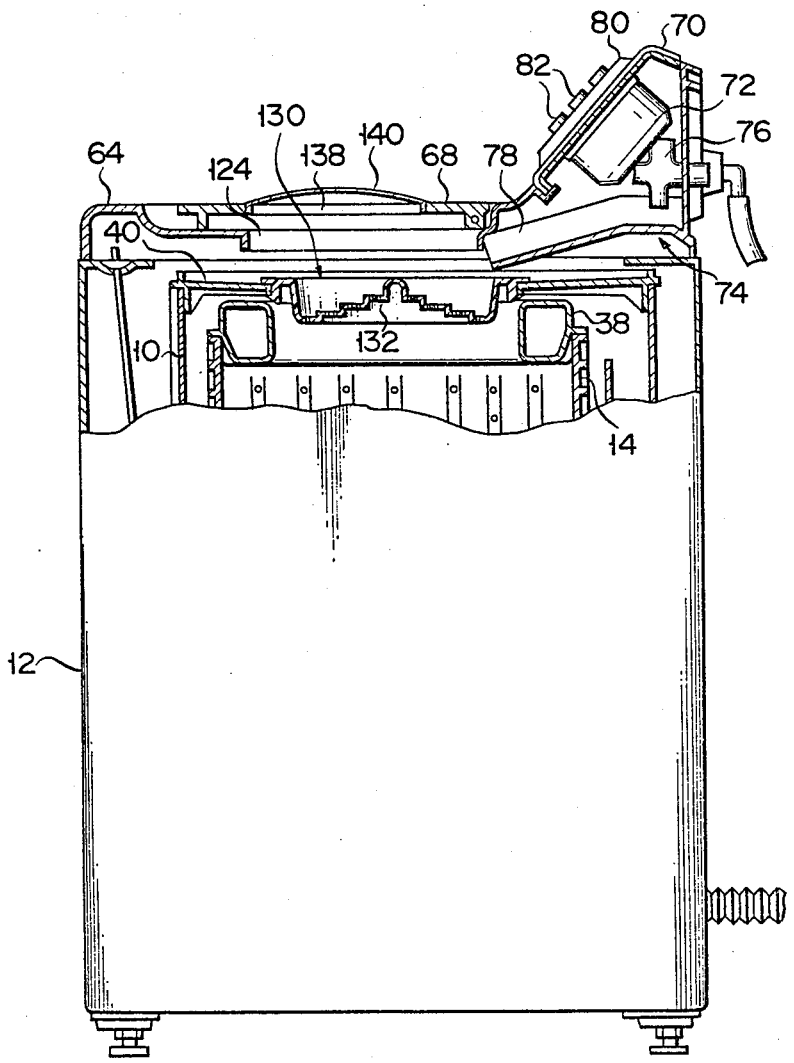
FIG. 12 is a cross sectional view showing an automatic washer according to still another embodiment of the present invention.
Figure 13:
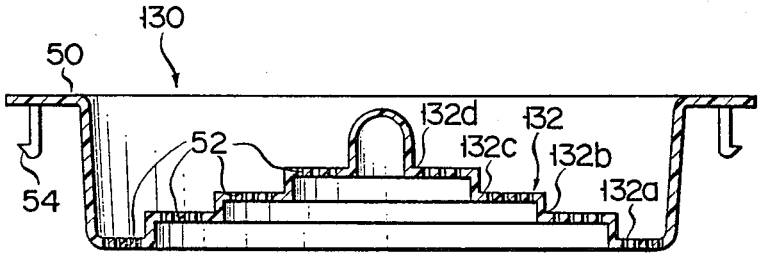
FIG. 13 is a cross sectional view showing in a magnified fashion the spraying device included in the washer shown in FIG. 12.
Figure 14:
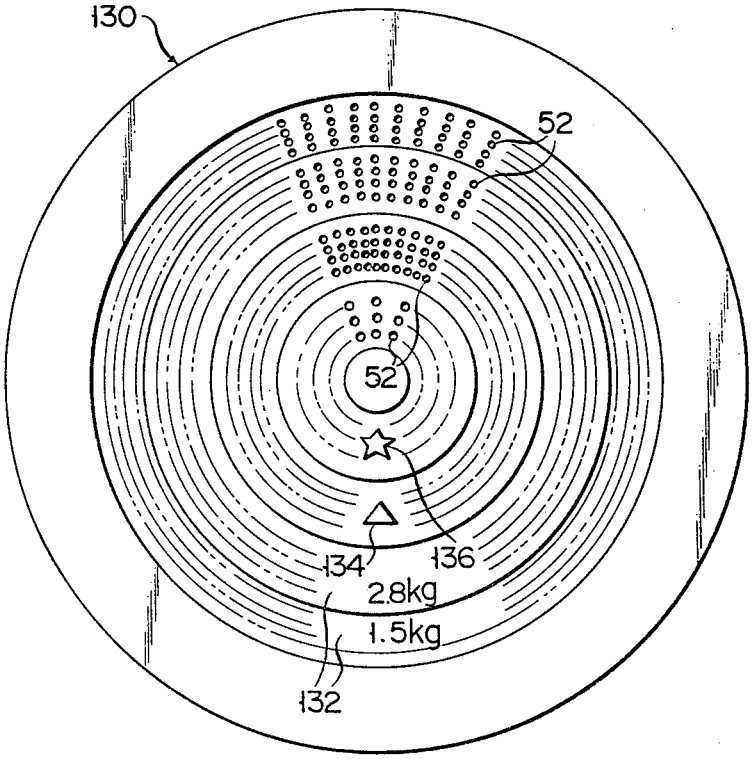
FIG. 14 is a plan view of the spraying device shown in FIG. 13.

FIG. 12 shows an automatic washer according to still another embodiment of the present invention. The washer comprises a spraying device 130. As shown in a magnified fashion in FIGS. 13 and 14, the spraying device 130 is provided with a stepped bottom 132, i.e., stepped upward from the periphery toward the center. The steps of the bottom are circular, concentric with each other, and equal to each other in height. Also, each step is provided with the small holes 52. It should be noted that each step of the stepped bottom 132 is marked with a numeral or symbol. Specifically, steps 132*a*, 132*b*, 132*c* and 132*d* of the stepped bottom 132 are marked "1.5 kg", "2.8 kg", delta mark 134 showing a plenty supply of water, and star mark 136 showing excessive amount of water, respectively. On the other hand, the lid 68 is provided in the center with an opening 138 and a transparent cover 140 which is mounted to close the opening 138 as shown in FIG. 12 so as to permit viewing the stepped bottom 132 of the spraying device 130 from above through the transparent cover 140. The washer shown in FIG. 12 is equal in construction to that shown in FIG. 1 except the above.

Figure 15:
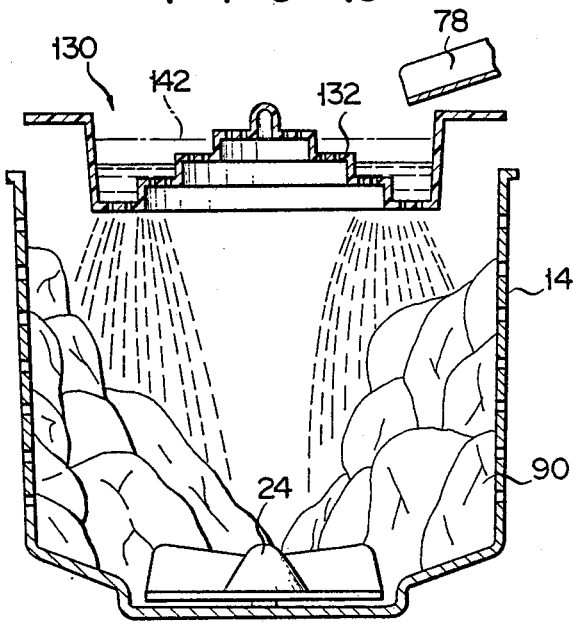
FIG. 15 shows how the water is sprayed into the basket from the spraying device shown in FIGS. 12 to 14.

In the embodiment of FIG. 12, an optimum amount of water can be sprayed from the spraying device 130 onto the washings 90 housed in the basket 14 regardless of the amount of the washings 90. Specifically, where the amount of the washings 90 is small, the washings 90 are centrifugally distributed along the peripheral wall of the basket 14. In this case, the fresh water supplied to the spraying device 130 is sprayed directly and uniformly onto the washing 90 distributed along the peripheral wall of the basket 14 through the holes 52 made in the lowest step 132*a* and in the adjacent step 132*b* of the stepped bottom 132 of the spraying device 130 as shown in FIG. 15. Where the amount of washing 90 is large, the fresh water supplied to the spraying device 130 is increased to reach a level denoted by a broken line 142 in FIG. 15. It should be noted that, where the amount of washing 90 is large, the washing 90 is partly distributed in the central portion of the basket 14 as well as along the peripheral wall of the basket 14 during rotation of the basket 14. However, the fresh water is sprayed onto the washings 90 through the holes 52 made in the third lowest step 132*c* as well as in the steps 132*a* and 132*b*. Naturally, the fresh water is sprayed through the holes 52 made in the step 132*c* onto the washings 90 distributed in the central portion of the basket 14. To be brief, the washer shown in FIG. 12 permits an optimum spraying of fresh water onto the washings 90 housed in the basket 14 regardless of the amount of washing 90 as mentioned previously. What should also be noted is that the numerals and marks put to the stepped bottom of the spraying device 130 can be observed through the transparent cover 140 mounted to the lid 68, rendering it possible to recognize accurately the optimum amount of water supply. When the water is excessively supplied to the spraying device, the operator can manually control the amount of water supplied into the spraying device in accordance with the amount of the washing 90 held in the rotary basket 14.

Figure 16:
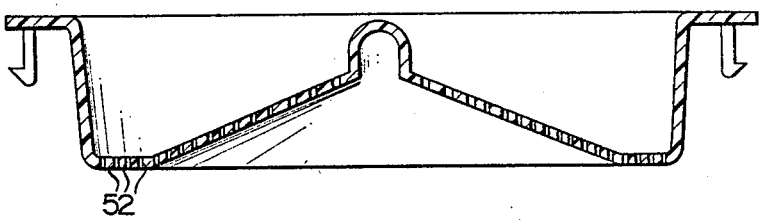
FIGS. 16 and 17 are cross sectional views each showing a modification of the spraying device mentioned above.

FIG. 16 shows a modification of the spraying device 130. In this modification, the bottom of the spraying device is linearly inclined upward toward the center, with the result that the water spraying region within the basket can be continuously expanded toward the center in accordance with an increase in the amount of the washing 90 housed in the basket 14.

Figure 17:
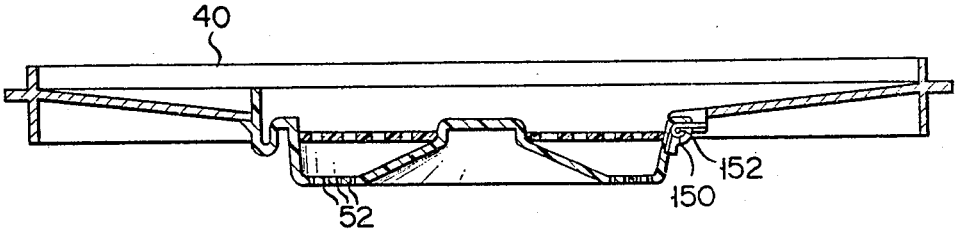

The present invention is not necessarily restricted to the embodiments described above; various modifications are available within the technical scope of the present invention. For example, the spraying device is swingably mounted to the tub cover 40 or upper case 64 in the present invention as described previously. It should be noted that an urging means, e.g., coil spring, may be used together in order to allow the spraying device to be urged in the upward swinging direction as shown in FIG. 17. Specifically, a shaft 152 is wound with a coil spring 150 in FIG. 17 so as to enable the spraying device to be swung upward easily.

What is claimed is:

1. An automatic washer for automatically carrying out in succession a plurality of steps of a washing operation including a specific centrifugal dehydration-rinsing step in which fresh water is sprayed onto washed material so as to simultaneously perform dehydration and rinsing of the washed material, said washer comprising:

(a) rotary basket means, having a pulsator member and an upper opening, for holding material to be washed which is loaded thereinto through the opening throughout the plurality of steps of the washing operation, said rotary basket means further including an inner peripheral wall defining a plurality of holes through which liquid such as water supplied thereinto flows to the outside;

(b) tub means housing said basket means for storing the liquid flowing through the holes of said basket means and for draining that liquid which is discharged through said holes and onto the washed material by the centrifugal force produced by the rotation of said basket means during said dehydration-rinsing step, said tub means having an upper opening corresponding to the opening of said basket means; and (c) spraying means immovably disposed to substanially cover said opening of said tub means for temporarily storing fresh rinsing water, which is supplied thereto in said dehydration-rinsing step, in a substantially still state and for preferentially spraying the stored water, by utilizing free fall of the stored water, evenly at least on that circular region of said basket means rotating to dehydrate the wet washed material which is located along said inner peripheral wall thereof wherein fresh water is effectively sprayed on the washed material being dehydrated in said rotating basket means to thus effectively carry out said dehydration-rinsing step.

2. An automatic washer according to claim 1, wherein said spraying means includes vessel means, having a bottom, an opening for receiving water supplied from the outside and a plurality of holes being made through the bottom of said vessel means.

3. An automatic washer according to claim 2, wherein the holes are substantially concentrated in the region along the side wall of said vessel means.

4. An automatic washer according to claim 2, wherein said spraying means further includes a lid member provided with a plurality of holes through which water, supplied from the outside, flows into said vessel means.

5. An automatic washer according to claim 2, wherein said spraying means further includes means for suppressing the waving of the water temporarily stored in said vessel means.

6. An automatic washer according to claim 5, wherein said waving suppressing means includes a plurality of annular projections extending upright from the bottom of said vessel means and concentric with each other.

7. An automatic washer according to claim 5, wherein said waving suppressing means includes a porous and fibrous material disposed within said vessel means.

8. An automatic washer according to claim 1, which further comprises a tub cover member disposed to close the opening of said tub means, and provided in the substantially central portion with an opening positioned above the opening of said rotary basket means, said spraying means being attached to said tub cover member.

9. An automatic washer according to claim 8, wherein said spraying means further includes a flange member extending radially outward from an opening end of said vessel means, and hook means mounted to said flange member for elastically and detachably engaging with said tub cover member whereby said spraying means is detachably mounted to close the opening of said tub cover member, said opening being positioned above the opening of said rotary basket means.

10. An automatic washer according to claim 1, wherein fresh water is sprayed from said spraying means onto the material to be washed held in said rotary basket means to carry out the rinsing operation.

11. An automatic washer according to claim 1, which further comprises means for swingably mounting said spraying means to a prescribed position of said washer, thereby enabling said spraying means to be swung outward when the material to be washed is loaded into or unloaded from said rotary basket means.

12. An automatic washer according to claim 1, wherein said spraying means includes means for controlling the water spraying region such that, when the amount of water supplied from the outside into said spraying means is smaller than a prescribed level, the water spray is restricted to the region along the side wall of said rotary basket means, and when the amount of water supplied into said spraying means increases over the prescribed level, the spraying region is expanded toward the center of said rotary basket means.

13. An automatic washer according to claim 12, wherein said spraying region controlling means includes such a vessel bottom that progressively increases toward the central region thereof, said vessel bottom having a plurality of holes provided in substantially the entire region thereof.

14. An automatic washer according to claim 13, wherein the vessel bottom of said spraying means includes a plurality of steps each marked with a numeral or symbol denoting a proper amount of water supply.

15. An automatic washer according to claim 14, wherein the numeral or symbol permits an operator to recognize the proper amount of water supply and manually control the amount of water supplied into said spraying means in accordance with the amount of the material to be washed held in said rotary basket means.

16. An automatic washer according to claim 1, wherein said spraying means comprises vessel means, having an upper opening for receiving fresh water supplied from the outside and a bottom defining a plurality of vessel holes, said vessel means for receiving a first amount of water therein at a first flow rate and for spraying a second amount of water through said vessel holes at a second flow rate slower than said first flow rate to establish a differential amount of water in said vessel means and to temporarily store said differential amount of water, said vessel means evenly supplying a shower of water to the washed material being dehydrated in said rotating basket means by permitting a free fall of water through said vessel holes, which free fall occurs due to a gravitational water-discharge pressure substantially evenly applied to said vessel holes by virtue of said differential amount of water.

17. An automatic washer according to claim 16, wherein said vessel means includes a vessel having a tubular recess which temporarily stores the fresh rinsing water and a bottom portion defining said vessel holes, said vessel spraying the water only around the circular region which is close to the periphery of said inner wall of said basket means and in which the washed material sticks on the inner wall of rotating basket means due to the centrifugal force generated by the rotation of said basket means, thereby permitting the fresh rinsing water to be sprayed directly onto the washed material distributed along the inner wall of said rotating basket means for effective utilization of water in the dehydration-rinsing step of said automatic washer.

18. An automatic washer according to claim 17, further comprising a tub cover member provided with a central opening and stably attached to the upper opening of said tub means, said vessel means of said spraying means being detachably mounted on the central opening so as to permit the material to be washed to be loaded into said basket means through the central opening from which said vessel means is removed, whereby said vessel means once mounted is always positioned above the opening of said basket means whether said basket means is rotated or stopped.

19. An automatic washer according to claim 17, wherein said spraying means further includes a circular lid member which is disposed a prescribed distance away from the bottom portion of said vessel recess and which has a number of water passing holes through which the fresh rinsing water is supplied to said vessel recess from the outside.

20. An automatic washer according to claim 19, wherein said vessel has a projection pole member vertically projecting from a central portion of said bottom portion of said vessel, said projection pole member defining said vessel recess and stably supporting said lid member.

21. An automatic washer according to claim 17, further comprising means provided to said spraying means, for suppressing the rippling of the rinsing water temporarily stored in said vessel recess, which rippling occurs due to the vibration of said rotating basket means, thereby preventing the water from being splashed outside said spraying means.

22. An automatic washer according to claim 21, wherein said ripple suppressing means includes a circular lid member which is disposed a prescribed distance away from the bottom portion of said vessel recess and which has a number of water passing holes through which the water is supplied to said recess of said vessel, said lid member serving to suppress the rippling surface of water when water having a height corresponding to said prescribed distance is stored in said vessel.

23. An automatic washer according to claim 22, wherein said vessel has a projection pole member vertically projecting from a central portion of said bottom portion of said vessel, said projection pole member defining said vessel recess and stably supporting said lid member.

* * * * *